US007040660B2

(12) United States Patent
Callista

(10) Patent No.: US 7,040,660 B2
(45) Date of Patent: May 9, 2006

(54) HALF-SHUTE

(75) Inventor: James Mead Callista, 3104 Ventnor Ave., Longport, NJ (US) 08403

(73) Assignee: James Mead Callista, Longport, NJ (US)

( * ) Notice: Subject to any disclaimer, the term of this patent is extended or adjusted under 35 U.S.C. 154(b) by 0 days.

(21) Appl. No.: 10/260,929

(22) Filed: Sep. 28, 2002

(65) Prior Publication Data

US 2003/0067155 A1 Apr. 10, 2003

Related U.S. Application Data

(60) Provisional application No. 60/327,170, filed on Oct. 5, 2001.

(51) Int. Cl.
*B63H 9/06* (2006.01)

(52) U.S. Cl. ..... 280/810; 114/102.11

(58) Field of Classification Search ..... 280/810, 280/809, 87.01, 87.042, 288.4, 213; 114/102.1, 114/102.11
See application file for complete search history.

(56) References Cited

U.S. PATENT DOCUMENTS 1,178,165 A * 4/1916 Lupton, Jr. ..... 280/810
1,859,178 A * 5/1932 Sprinkle ..... 280/810
2,213,754 A * 9/1940 Thirring ..... 280/810
2,577,917 A * 12/1951 Root ..... 441/76
2,793,870 A * 5/1957 Rowman ..... 280/810
3,742,886 A * 7/1973 Dillon ..... 114/39.28
3,768,823 A * 10/1973 Goldberg ..... 280/810
3,830,512 A * 8/1974 Spiegel ..... 280/810
3,924,870 A * 12/1975 Spivack et al. ..... 280/810
3,982,766 A * 9/1976 Budge ..... 280/1
4,049,287 A * 9/1977 Dudouyt ..... 280/213
4,130,292 A * 12/1978 Lorenz ..... 280/810
4,200,302 A * 4/1980 de Rosnay ..... 280/1
4,269,133 A * 5/1981 Brown ..... 114/102.11
4,311,324 A * 1/1982 Fries ..... 280/810
4,527,794 A * 7/1985 Dunn ..... 482/59
4,557,495 A * 12/1985 Kindermann ..... 280/213
4,617,871 A * 10/1986 Yau ..... 114/39.24
4,831,950 A * 5/1989 Allured ..... 114/39.28
4,978,140 A * 12/1990 Babson ..... 280/810
4,991,861 A * 2/1991 Carn et al. ..... 280/87.042
5,924,732 A * 7/1999 Olsen ..... 280/810

* cited by examiner

*Primary Examiner*—Christopher P. Ellis
*Assistant Examiner*—Jeff Restifo

(57) ABSTRACT

The HALF-SHUTE is directed as an accessory to propel skateboards with the power of the wind. It can easily be carried around the waist of the user when not in use. It includes a one-dimensional diamond piece of fabric.
It's diamond shape bellows out in the center to capture more wind. The Edges are reinforced with double layer, folded over, material. The outer perimeter is re-enforced with heavy duty stitching. At each of the lateral ends there are attachments for the user's wrists. The inferior point of the Shute attaches to a flexible cord, which in turn attaches to an eyebolt, which is secure on the skateboard.

11 Claims, 2 Drawing Sheets

HALF-SHUTE

CROSS-REFERENCE TO RELATED APPLICATIONS

This application claims the benefit of U.S. Provisional Patent Application Ser. No. 60/327,170 filed Oct. 5, 2001.

| | | | |
|---|---|---|---|
| 4,311,324 | January 1982 | Fries | 280/810 |

BACKGROUND OF THE INVENTION

1. Field of the Invention

The present invention relates generally to sails and skateboards.

2. Brief Description of the Prior Art

Skateboards generally consist of a planar support surface and four wheels. Users stand upon the support surface and typically propel the skateboard by exerting force upon the ground with one foot.

Sails generally consist of flexible material and one or more supports for retaining the material in a vertical position. Sails are used on boats and other watercraft, which are in turn propelled by the force of wind.

Devices have been developed in the prior art for propelling skates this being typified by and described in U.S. Pat. No. 4,311,324 to James E. Fries. The device of Fries patent involves a sail, although very functional in capturing wind, its large size and stiff cross bar make impracticable and undesirable for use with any skateboard.

The Fries patent addressees the problem of fatigue and maneuverability, but not only does he not eliminate the problem, his invention adds to the dilemma. Fires invention requires a large rigid pole to support his sail. The aforementioned is not only a burden and tiresome, but it also isolates and greatly restricts the arm's movements. In addition, the pole also extremely limits the rider's maneuverability and performance, which are paramount to a skateboarder. When applied to skateboarding Fries device eliminates the possibility of doing most skateboarders' tricks and moves.

SUMMARY OF THE INVENTION

The device of the present invention provides a substantial improvement over prior sails for skaters. This improvement is achieved by employing a design solely for skateboarders.

The present invention is directed to a sail accessory for skateboards. In one embodiment, the sail accessory comprises a one-dimensional horizontal diamond piece of fabric. The diamond shape bellows out in the center to capture more wind. Edges are reinforced with double layer, folded over, material. The outer perimeter is re-enforced with heavy duty stitching. At each of the lateral ends there is a pair of eyelets to secure kite lines. The kite lines in turn are secured to attachments for the user's wrists. The inferior point of the fabric has a detachable and removable tail that contains an eyelet on its inferior point, which in turn is used to attach a line and or flexible cord. The cord in turn attaches to an eyebolt, which is secure on the skateboard.

The present invention is also directed to a new method of using skateboards. In one embodiment, the method comprises a sail accessory.

An advantage of an embodiment of the present invention is to provide a new sail accessory for skateboards.

Another advantage of an embodiment of the present invention is to provide a new sail accessory for skateboards, which may be easily and efficiently manufactured and marketed.

Still another advantage of an embodiment of the present invention is to provide a sail accessory for skateboards, which is of durable and reliable construction.

Another advantage of an embodiment of the present invention is to provide a sail, due to its unique design, that will permit skateboarders to perform their maneuvers with minimal restrictions from the sail.

An Additional advantage of an embodiment of the present invention is to provide a sail that will enable the user to obtain an aerodynamic lift, by pulling their arms back and downward, when descending from jumps and half pipes.

An even further advantage of an embodiment of the present invention is to provide a sail accessory for skateboards which is susceptible of a low cost of manufacture with regard to both materials and labor, and which accordingly is then susceptible of low prices of sale to the consuming public, thereby making such product economically available to the buying public.

Still yet another advantage of an embodiment of the present invention is to provide a sail accessory for skateboards and novel method of use to propel skateboards by power of the wind.

There are additional advantages of embodiments of the present invention that will be described hereinafter and which will form the subject matter of the claims appended hereto.

DETAILLED DESCRIPTION OF THE INVENTION

Figure 1:
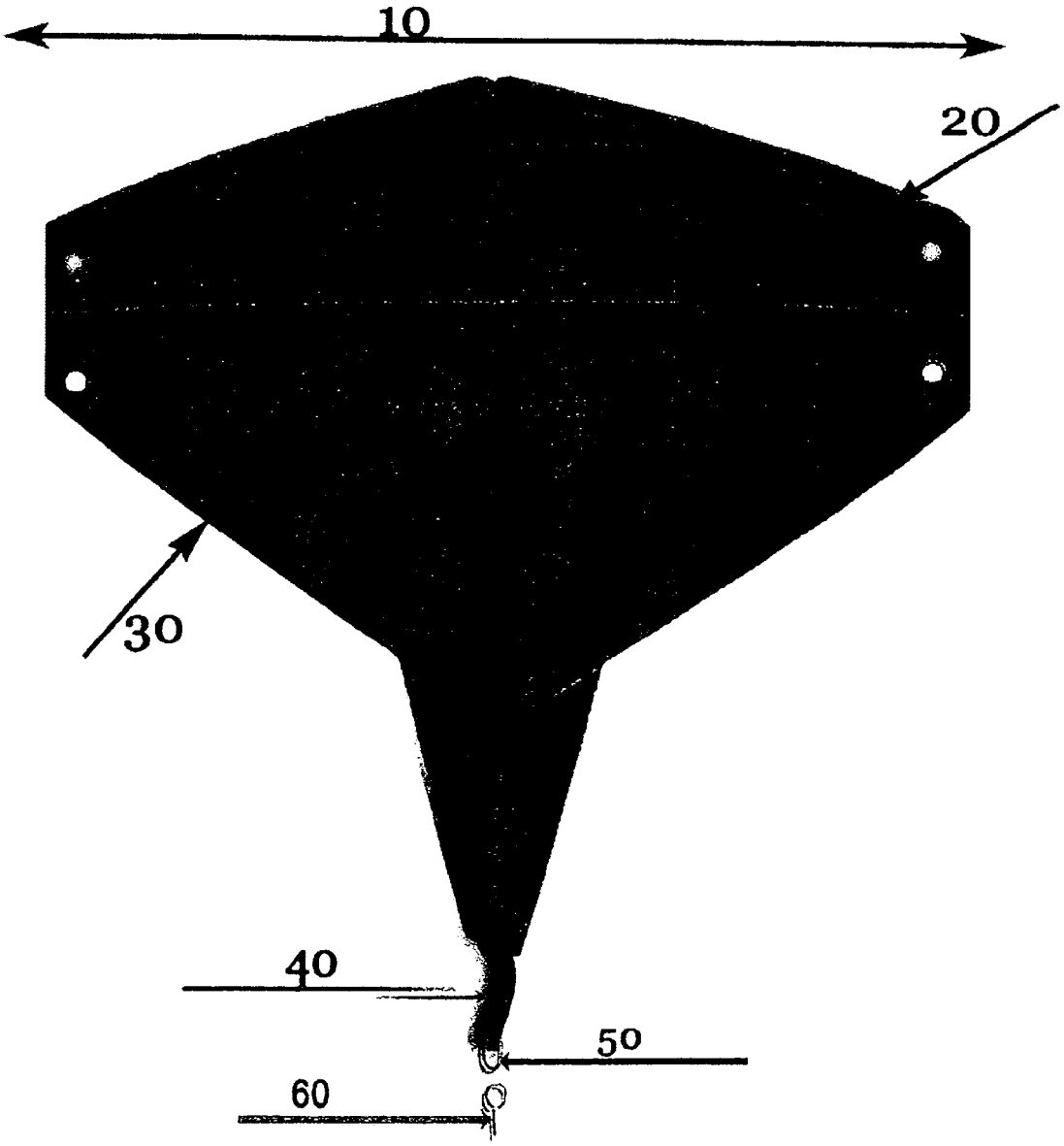
FIG. 1 is a front perspective view of an embodiment of a sail accessory according to the present invention.

For a better understanding of the invention, its operating advantages and the specific advantages attained by its uses, reference should be had to the accompanying drawings and descriptive matter in which there is illustrated a preferred embodiment of the invention. In this respect, before explaining a least one embodiment of the invention in detail, it is to be understood that the invention is not limited in its application of the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

Figure 2:
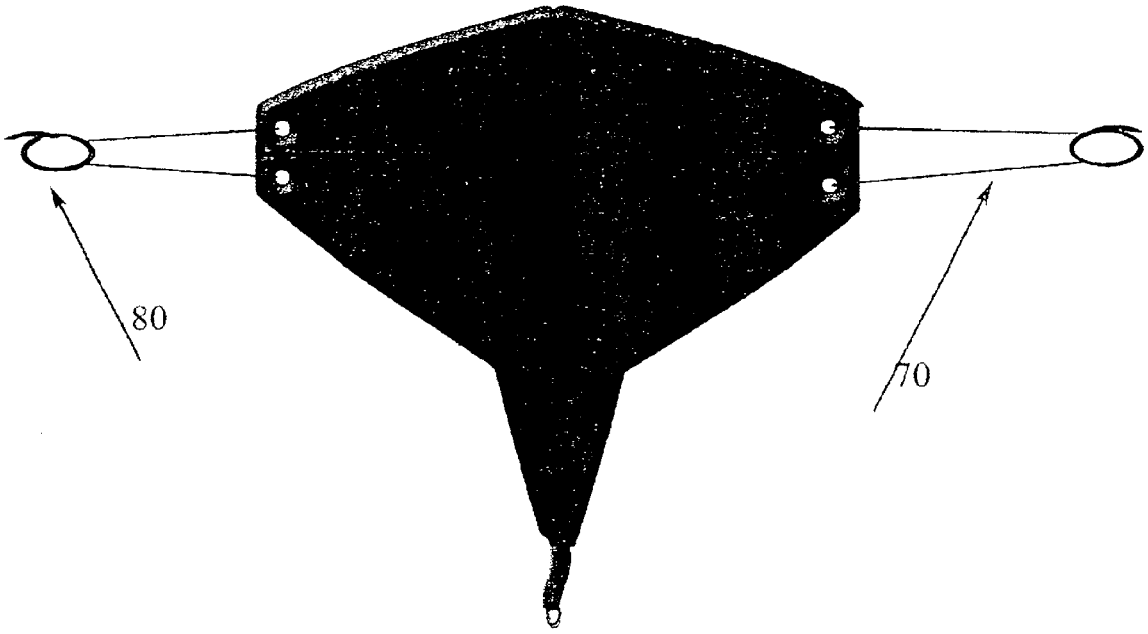
FIG. 2 is a rear perspective view of a sail accessory according to the present invention.

With reference now to the drawings in detail, in FIGS. 1 and 2 is illustrated an exemplary embodiment of a sail accessory for a skateboard in accordance with the present invention, which applicant has termed. Half-Shute™.

As best illustrated in FIG. 1, the Half-Shute 10 comprises a main sail 20. In this embodiment, the Half-Shute 10 preferably measures approximately 82 inches wide and 48 inches in height at its largest point. The Half-Shute's height in the present embodiment tapers downwardly from its center point at a maximum of about 48 inches to a minimum of about 24 inches at its lateral ends.

In the preferred embodiment the Half Shute will be generally diamond in shape and the lateral ends being primarily vertical and parallel.

In the present embodiment, the Half-Shute 10 is manufactured of a lightweight material, such as a lightweight fabric, for example and without limitation, nylon or any other suitable materials adaptable for use in lightweight sails and parachutes.

The edges are preferably re-enforced with either lightweight guide wires or re-enforced stitching.

A removable tail 30 of the Half-Shute 10 in this embodiment is attached to the inferior point of the inferior point of the Shute, using a velcro strip, and is approximately 16–20 inches long. The tail is approximately 16 inches wide at its top most vertical point, tapering down to approximately 6 inches wide at its most inferior point.

The ⅝-inch battens 90 are ⅝ inches in diameter and located at the horizontal and vertical midpoints. The battens are to be used on days of low wind velocity and hence are removable and optional.

In addition, in the present embodiment, a cord 40, preferably a coiled length of elastomeric cord or similar flexible material, such as a BUNGEE cord 40 shown in the FIG. 1 is attached to the inferior point of the tail. A heavy-duty kite line may be used in lieu of, or in conjunction with. elastic cords. The inferior point of the BUNGEE cord is preferably attached to an oblong 1 and ½-inch spring link metal hook 50. The spring link will be attached to a 5/16 eyebolt 60. As should be understood, other suitable types of connecting devices can also be use where desired. The eyebolt in this embodiment is preferably attached 6 inches posterior from the most anterior point of the skateboard and includes one 5/16-fender washer above, and one below the board, although as should be understood. Below the inferior fender washer is preferably a 5/16-lock washer and nut.

As best illustrated in FIG. 2, the illustration's posterior view shows the lateral ends of the Half-Shute 10 attached to cords 70, which are preferably comprised of a flexible material, such as an elastomeric. Heavy-duty kite lines may be used in lieu of or in conjunction with elastic cords. These cords in turn are attached to wrist straps 80, which are VELCRO in this embodiment.

The Half-Shute is used to propel the skateboard and its user in the direction of the wind. Preferably, a minimum wind velocity of 18 knots is required; but that is not necessary and lower wind velocity can also provide sufficient operation.

The Half-Shute can also be used as an aerodynamic lift; by the rider pulling their arms back and downward while descending from a jump or half-pipe.

In a preferred embodiment, the diamond shape of the device tapers down at its lateral ends to the medial ends of two flexible cords and or kite lines. The ends of such cords attach to two VELCRO wrist straps.

The inferior point of the device is connected to a tail, which in turn attaches to a kite line, and or BUNGEE cord (or a coiled length of elastomeric cord). Such cord in turn attaches to oblong spring link. A 5/16-eye bolt attaches to the spring link at its superior end and into the skateboard at its inferior end.

In a preferred embodiment, the Half-Shute is capable of being used with an all terrain skateboard. A foot block, such as measuring 1 inch in height and 6 inches in length, is secured by any suitable means, such as an adhesive or fastener, and parallel to the anterior of the board. The purpose of the footboard is to prevent the rider from sliding forward on the board.

The Half-Shute is preferably attached to the front of an all-terrain or mountain skateboard, but a standard skateboard will be sufficient as well.

The lateral ends of the Half Shute are preferably attached to a rider's wrists, via kite lines and or elastomeric cords, using hook and look straps, preferably made of VELCRO.

The Half-Shute is most operable when being used with a wind velocity between 18 and 25 knots. The direction of turns is controlled by appropriately pulling in either ones right or left arms towards the sides of the body.

With respect to the above description then, it is to be realized that the optimum dimensional relationship for the parts of the invention, to include variations in size, materials, shape, form, function, and manner of operation, assembly and use, are deemed readily apparent and obvious to one skilled in the art, and all equivalent relationships to those illustrated in the drawings and described in the specifications are intended to be encompassed by the present invention.

Therefore, the foregoing is considered an illustrative only of the principles of the invention. Further, since numerous modifications and change will readily occur to those skilled in the art, it is not desired to limit the invention to the exact construction and operation shown and described, and accordingly, all suitable modifications and equivalent may be resorted to, falling with the scope of the invention.

I claim:

1. A wind capturing device for a skateboard comprising;

a generally diamond-shaped main sail having a width to height ratio of about 2.25:1, at least one vertical and at least one horizontal flexible and removable battens for reinforcing said sail, a generally triangular shaped tail attached to an inferior point of said sail and tapering downward, a flexible wrist attachment on each superior lateral end of said sail adapted to be secured to a rider's wrists, a flexible and elastic cord attached to an inferior point of said tail, a quick-release mechanism for attaching said cord to a skateboard, wherein said wind capturing device enables a rider to obtain aerodynamic lift during maneuvers by backward and downward arm movement of the rider.

2. The wind capturing device of claim 1, wherein said wrist attachments are secured to a user's wrist by means of hook and loop fasteners.

3. The wind capturing device of claim 1, wherein said tail has a vertical length half that of the sail and said tail tapers downward at a ratio of about 3:1.

4. The wind capturing device of claim 1, wherein said quick-release mechanism is a hook and eyebolt connection.

5. A wind capturing device for a skateboard comprising;

a generally diamond-shaped main sail, at least one vertical and at least one horizontal flexible and removable battens for reinforcing said sail, a generally triangular shaped, removable tail, attached to an inferior point of said sail and tapering downward, a flexible wrist attachment on each superior lateral end of said sail adapted to be secured to a rider's wrists, a flexible and elastic cord and or line, attached to an inferior point of said tail, a quick-release mechanism for attaching said cord and or line to a skateboard, wherein said wind capturing device enables a rider to be propelled by the velocity of the wind, wherein said wind capturing device enables a rider to obtain aerodynamic lifts during maneuvers by backward and downward arm movements of the rider.

6. The wind capturing device of claim 5, wherein a pair of lines are secured to the said sail on each lateral end.

7. The lines of claim 6, wherein a wrist attachment can be secured to each pair of lines.

8. The wind capturing device of claim 5, wherein said wrist attachments are secured to a user's wrist by means of hook and loop fasteners.

9. The wind capturing device of claim 5, wherein said tail is detachable.

10. The wind capturing device of claim 5, wherein said quick-release mechanism is a hook and eyebolt connection.

11. The line of claim 7, wherein said sail wrist attachments may be secured to the lines' lateral ends via a kite pole.

* * * * *